United States Patent [19]

Zinniel et al.

[11] Patent Number: 4,901,490

[45] Date of Patent: Feb. 20, 1990

[54] RAISED FLOORING PANEL AND RAISED FLOORING ASSEMBLIES

[75] Inventors: Francis R. Zinniel, Gilroy; John G. Barbero, San Jose; Louis J. Saccullo, deceased, late of Gilroy, all of Calif., by Josephine F. Saccullo, heir

[73] Assignee: Gabalan Corporation, Morgan Hill, Calif.

[21] Appl. No.: 682,608

[22] Filed: Dec. 17, 1984

[51] Int. Cl.[4] ..... E04B 5/43

[52] U.S. Cl. ..... 52/263; 52/309.1; 52/126.6; 52/720; 248/644; 248/346

[58] Field of Search ..... 52/126.6, 263, 177, 52/720, 309.1, 263; 248/644, 670, 346

[56] References Cited

U.S. PATENT DOCUMENTS

| | | | |
|---|---|---|---|
| 3,180,460 | 4/1965 | Liskey, Jr. . | |
| 3,279,134 | 10/1966 | Donovan | 52/126 |
| 3,316,680 | 5/1967 | Chrastek | 52/126 |
| 3,318,057 | 5/1967 | Norsworthy | 52/126 |
| 3,324,614 | 6/1967 | Loewenau | 52/263 |
| 3,681,882 | 8/1972 | Bettinger | 52/126 |
| 3,696,578 | 10/1972 | Swensen et al. | 52/126.6 |
| 3,789,557 | 2/1974 | Harvey | 52/263 |
| 3,811,237 | 5/1974 | Bettinger | 52/126 |
| 3,946,529 | 3/1976 | Chevaux | 52/390 |
| 3,964,221 | 6/1976 | Berquist | 52/177 |
| 4,011,703 | 3/1977 | Tanzilli | 52/618 |
| 4,085,557 | 4/1978 | Tharp | 52/263 |
| 4,258,516 | 3/1981 | Mori et al. | 52/126 |
| 4,522,009 | 6/1985 | Fingerson | 52/177 |

OTHER PUBLICATIONS

Brochure entitled Liskey Mark 30 System, Liskey, Inc. 8/1982.

Brochure entitled S Floor, Innocrete Systems, Inc., 1982.

*Primary Examiner*—David A. Scherbel
*Assistant Examiner*—Caroline D. Dennison
*Attorney, Agent, or Firm*—Jack M. Wiseman

[57] ABSTRACT

Disclosed is a unitary, injection-molded raised flooring panel adapted for use in a raised flooring assembly. The raised flooring assembly includes a grid of flooring panel support stringers onto which the flooring panel is supported. The unitary, injection-molded raised flooring panel includes a continuous flooring wall the upper surface of which is the flooring surface of a panel and a plurality of depending, mutually intersecting reinforcing ribs formed integrally with the flooring wall of the panel. In the preferred embodiment, the flooring panel is made of a thermoplastic material, a thermosetting plastic material or a synthetic polymeric resin material. Thus, the disclosed flooring panel may be completely fabricated in a single manufacturing operation.

4 Claims, 2 Drawing Sheets fig_1
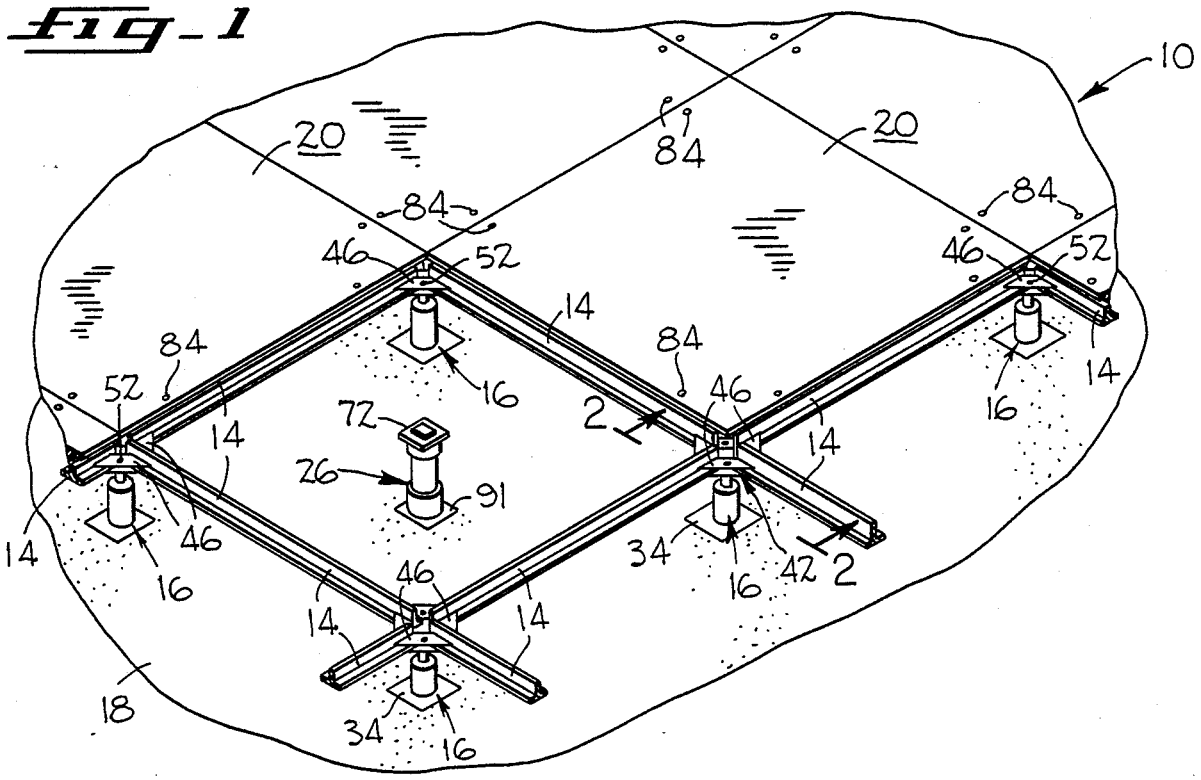
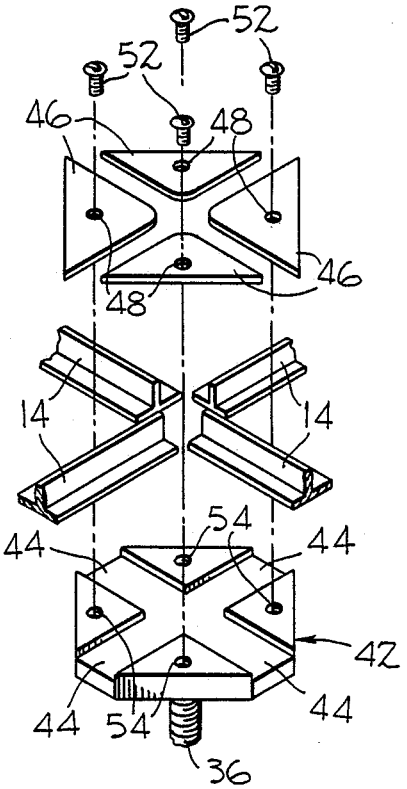
fig_3
fig_2
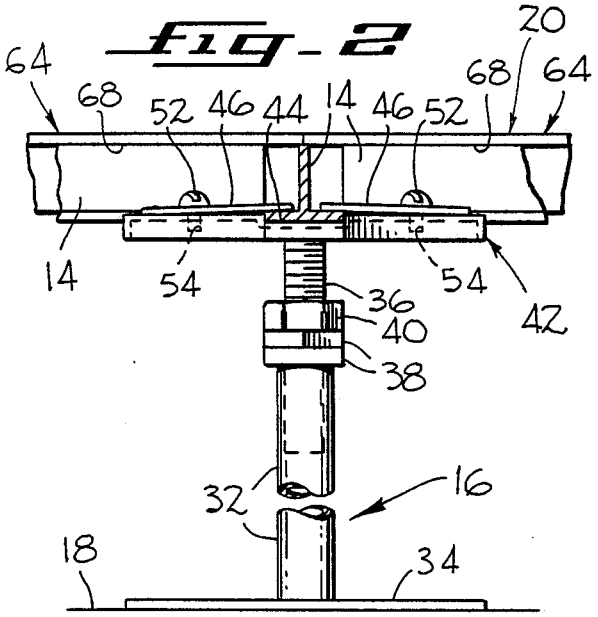

RAISED FLOORING PANEL AND RAISED FLOORING ASSEMBLIES

BACKGROUND OF THE INVENTION

The present invention relates in general to raised flooring panels and raised flooring assemblies, and more particularly to a raised flooring panel and a raised flooring assembly with improved structural characteristics.

Raised flooring has heretofore been employed in the construction of buildings. Liskey, Inc. has sold raised flooring panels with radial rib design and raised flooring assemblies with stringers forming a grid. Innocrete Systems, Inc. has sold access flooring or elevated flooring panels and elevated flooring assemblies. The panels were made of a silicate compound. In the patent to Liskey, Jr., U.S. Pat. No. 3,180,460, issued on Apr. 27, 1965, for Floor Panel For Elevated Flooring, there is disclosed an elevated floor comprised of stringers and floor panels. The floor covering above the floor panel is composed of rubber or plastic tile. The floor panel is fabricated or extruded aluminum. Thus, the floor panel has a rubber or plastic tile thereabove as a floor covering and is composed of the extruded aluminum sections.

The patent to Chevaux, U.S. Pat. No. 3,946,529, issued on Mar. 30, 1976, for Floor For Sports And Particularly For Roller Skating, discloses a floor for roller skating. A deck plate is formed and molded or injected molded plastic tiles are installed on the top of the deck plate. While the patent to Donovan, U.S. Pat. No. 3,279,134, issued on Oct. 18, 1966, for Elevated Floor Construction, discloses panels made of vinyl, asphalt, cork and the like. Reinforcing members project from the bottom of the panels. In the patent to Bettinger, U.S. Pat. No. 3,811,237, issued on May 21, 1974, for Raised Floor Panel And Assembly, the panel comprises a core made of high density particle board, such as compressed wood particles.

In the patent to Tharp, U.S. Pat. No. 4,085,557, issued on Apr. 25, 1978, for Raised Access Floor Systems, there is disclosed a floor panel made of a relatively thick chip board material disposed in a pan. A polyvinyl chloride impact molding is fitted between the chip board material and the inner wall of the pan. The polyvinyl chloride molding frames a sheet of galvanized steel on which a carpet is fitted. The patent to Mori et al., U.S. Pat. No. 4,258,516, issued on Mar. 31, 1981, for Apparatus For Supporting Floor Plates Above Substrate, discloses forming a floor panel from at least two veneer boards with an intermediate layer of a rubber-like elastic material, such as butadiene acrylonitrile rubber, polyisobutylene rubber, ethylene-propylene rubber, or may be formed of a rubber composition formed of rubber-like elastic material blended with polyvinyl chloride, polybutene or inorganic filler.

The patent to Tanzilli, U.S. Pat. No. 4,011,703, issued on Mar. 15, 1977, for Building Elements For Making Insulating Panels And Panels Assembled Therefrom, discloses upper and lower tile plates in a staggered relation. The plates are integrally molded in a material, such as synthetic resin or impact resistant polyvinyl chloride. The patent to Norsworthy, U.S. Pat. No. 3,318,057, issued on May 9, 1967, for Pedestal Floor Construction, discloses using flooring panels formed from sheet wood, such as plywood or a preformed, reinforced metal pan.

SUMMARY OF THE PRESENT INVENTION

An object of the present invention is to provide an improved raised flooring panel which is electrically insulating.

Another object of the present invention is to provide an improved raised flooring panel which is relatively light.

Another object of the present invention is to provide an improved raised flooring panel which is relatively inexpensive to manufacture and install.

Another object of the present invention is to provide an improved raised flooring panel which is more easily adapted to the shape of mating structures during its installation.

Another object of the present invention is to provide an improved raised flooring panel which is relatively simple to manufacture.

Briefly, the present invention is a unitary, injection-molded raised flooring panel adapted to be received onto a grid of flooring panel support stringers. The unitary, injection-molded raised flooring panel includes a continuous flooring wall, the upper surface of which is the flooring surface of panels. Formed integrally with and depending beneath the continuous flooring wall of the flooring panels are a plurality of mutually intersecting reinforcing ribs. In its preferred embodiment, the intersecting reinforcing ribs at the center of the flooring panels seat on a panel support pedestal. In the preferred embodiment, the flooring panel is formed from a thermoplastic, or a thermosetting plastic, or a synthetic, polymeric resin material which is fabricated into the panel in a single manufacturing operation. The unitary, injection-molded raised flooring panel of the present invention requires no additional covering on its flooring surface, such as flooring tiles or carpeting.

DESCRIPTION OF THE DRAWINGS

FIG. 1 is a diagrammatic perspective view illustrating a fragmentary raised flooring assembly embodying the present invention with a flooring panel removed to illustrate a grid of flooring panel support stringers supported upon grid support pedestals, and a panel support pedestal.

FIG. 2 is a fragmentary, diagrammatic elevational view of flooring panel support stringers assembled onto a grid support pedestal of a unitary, injection-molded raised flooring panel taken along line 2—2 of FIG. 1 with the support stringer shown partially in section.

FIG. 3 is an exploded, diagrammatic perspective view depicting an assembly of the flooring panel support stringers onto a grid support pedestal embodied in the raised flooring assembly of the present invention.

DETAILED DESCRIPTION OF THE PREFERRED EMBODIMENT

Figure 4:
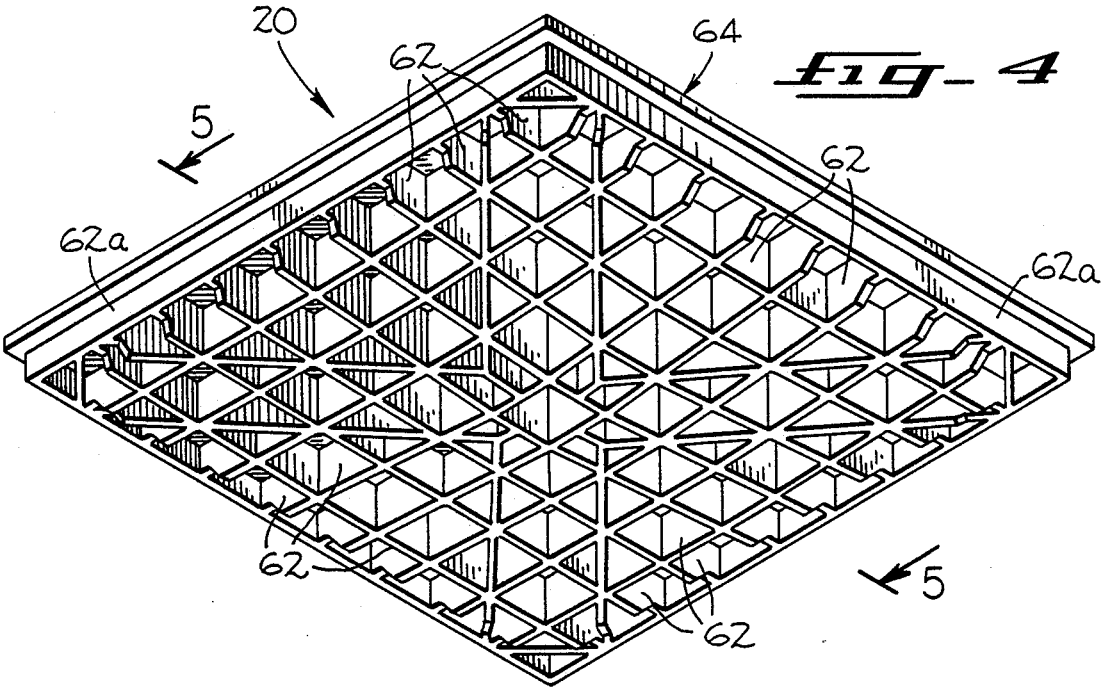
FIG. 4 is a diagrammatic perspective view of a unitary, injection-molded raised flooring panel embodying the present invention showing its mutually intersecting reinforcing ribs which depend downward from its flooring wall.

Illustrated in FIG. 1 is a raised flooring assembly 10 embodying the present invention. The raised flooring assembly 10 includes a grid 12 assembled from a plurality of metallic, inverted, T-shaped flooring panel support stringers 14. The panel support stringers 14 are supported on a plurality of grid support pedestals 16 which rest on a subfloor 18. Supported by the grid 12 are a plurality of square-shaped unitary, injection-molded raised flooring panels 20. Located above the center of each unitary, injection-molded raised flooring panel 20 and also resting on the subfloor 18 is a panel support pedestal 26 which supports the center of the unitary, injection-molded raised flooring panel 20.

Referring now to FIG. 2, each grid support pedestal 16 includes a metallic, hollow pedestal tube 32 secured to a metallic base plate 34 which rests on the subfloor 18. Received into each hollow pedestal tube 32 is a metallic, threaded pedestal jack 36 onto which a pair of leveling nuts 38 are secured and about which a locking cap 40 is disposed. When the raised flooring assembly 10 is being installed, the leveling nuts 38 of each grid support pedestal 16 are adjusted to establish the height of the grid 12 above the subfloor 18 and then the leveling nuts 38 are tightened together. After the leveling nuts 38 have been tightened together, the locking cap 40 of each grid support pedestal 16 is lowered over the leveling nuts 38. Thus, the locking cap 40 prevents spontaneous loosening of the leveling nuts 38 and consequently keeps the height of each of the grid support pedestals 16 in the adjusted position.

Secured to the uppermost end of the pedestal jack 36 is a square-shaped, metallic pedestal head 42 upon which the flooring panel support stringers 14 are supported. Referring now to FIG. 3, formed into the uppermost surface of the square-shaped pedestal head 42 of each grid support pedestal 16 are four U-shaped troughs 44 in which the inverted, T-shaped flooring panel support stringers 14 are received. The troughs 44 extend radially outward from the center of the pedestal head 42 thus forming an X-shape centered about the middle of the pedestal head 42.

In assembling the grid 12, after the terminal ends of each flooring panel support stringer 14 have been received into one of the troughs 44, a triangularly-shaped stringer clamping plate 46 having an aperture 48 formed therethrough is placed onto the terminal ends of each pair of immediately adjacent flooring panel support stringers 14. A screw fastener 52 is then passed through the aperture 48 and secured into one of four mating threaded apertures 54 formed into the pedestal head 42. Thus, when fully assembled, the pedestal head 42 of each grid support pedestal 16 has the terminals ends of four inverted, T-shaped flooring panel support stringers 14 respectively received into the four U-shaped troughs 44 formed into its upper surface. Further, each threaded aperture 54 of the pedestal head 42 has secured thereinto the screw fastener 52 which passes through the aperture 48 respectively formed through each of the four stringer clamping plates 46 places onto the terminal ends of each pair of immediately adjacent flooring panel support stringers 14.

Figure 5:
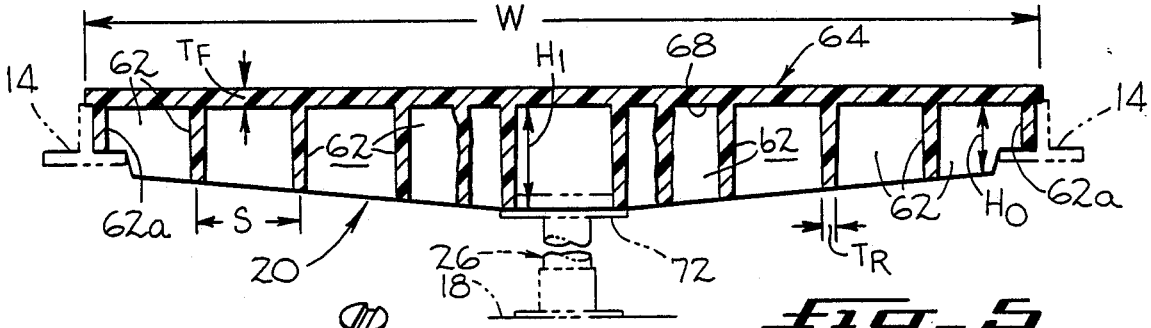
FIG. 5 is a diagrammatic, vertical sectional view of the unitary, injection-molded raised flooring panel taken along line 5—5 of FIG. 4.
Figure 7:
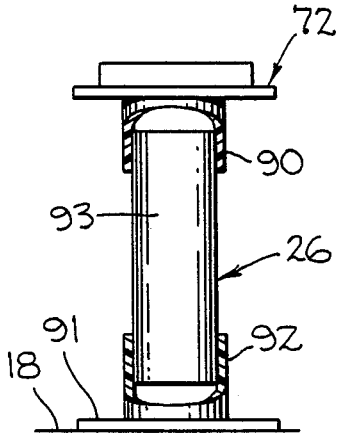
FIG. 7 is a diagrammatic elevation view, partially in section, of a panel support pedestal employed in the present invention.

Referring now to FIG. 4, depicted there is the unitary, injection-molded raised flooring panel 20 constructed in accordance with the present invention. The unitary, injection-molded raised flooring panel 20 includes a base 62*a* and a plurality of mutually intersecting reinforcing ribs 62 formed integrally with and depending from a continuous flooring wall 64. The base 62*a* extends along the perimeter of the panel 20. The reinforcing ribs 62 project away from an upper flooring surface 68 of the flooring wall 64 (FIG. 5) to form a lower surface for the reinforcing ribs 62. The reinforcing ribs 62 depend from the lower surface of the flooring surface 68. The center of the unitary, injection-molded raised flooring panel 20 is supported by a square-shaped panel support head 72 of the panel support pedestal 26 shown in FIGS. 5 and 7.

In the preferred embodiment, the square-shaped unitary, injection-molded raised flooring panels 20 are made of thermoplastic material, such as acrylonitrile butadiene polystyrene, polyvinyl chloride, polystyrene, polycarbonate, phenolic resins or ureas, or a synthetic, polymeric resin material. The flooring wall 64 of the panel 20 has a nominal width "W" of 24 inches and nominal thickness "$T_f$" of 0.380 inches, and the mutually intersecting reinforcing ribs 62 have a nominal center-to-center separation "S" between 2.500 and 2.750 inches, a nominal thickness "$T_r$" at the flooring wall 64 of 0.31 inches, a nominal height "$H_i$" about the panel support aperture 66 of 2.5 inches, and a nominal height "$H_o$" of 1.7 inches at the outer edge of the unitary, injection-molded raised flooring panel 20 immediately adjacent to the flooring panel support stringer 14.

Using the above-delineated material to fabricate the unitary, injection-molded raised flooring panel 20 produces a panel 20 which is electrically insulating, relatively light, and easily cut. Further, the spacing and arrangement of the mutually intersecting reinforcing ribs 62 described above and depicted in FIGS. 4 and 5 provides a unitary, injection-molded raised flooring panel 20 which is easily adapted during installation of the raised flooring assembly 10 to the shape of mating structures, such as walls of a building, without deleteriously affecting the overall weight bearing characteristics of the unitary, injection-molded raised flooring panel 20. The unitary, injection-molded raised flooring panel 20 of the present invention requires no additional covering material on its upper flooring surface 68, such as flooring tiles or carpeting, normally heretofore used with raised flooring panels. The unitary, injection-molded raised flooring panel 20 of the present invention may be completely fabricated in a single injection molding operation. The raised flooring assembly 10 of the present invention employing the unitary, injection-molded raised flooring panel 20 is relatively simple and inexpensive to manufacture and install.

Figure 6:
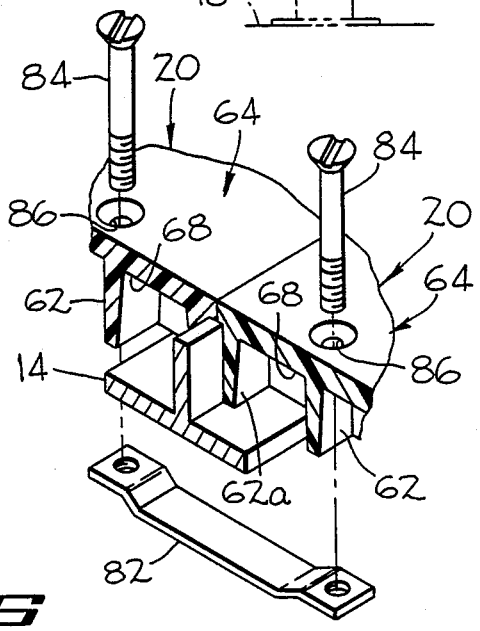
FIG. 6 is a diagrammatic, exploded vertical sectional view illustrating a flooring panel stringer clamp arranged for securing each of its terminal ends to one of a pair of unitary, injectionmolded raised flooring panels.

Referring now to FIG. 6, depicted there is a flooring panel stringer clamp 82 which passes beneath the flooring panel support stringer 14 to secure a pair of unitary, injection-molded raised flooring panels 20 thereto. Thus, the flooring panel stringer clamp 82 prevents inadvertently displacing the pair of unitary, injection-molded raised flooring panels 20 from the flooring panel support stringer 14 due to the light weight of the unitary, injection-molded raised flooring panels 20. The flooring panel stringer clamp 82 is secured beneath the flooring panel support stringer 14 by respectively fastening each of its terminal ends to one of the pair of unitary, injection-molded raised flooring panels by a threaded fastener 84 passing through an aperture 86 formed through each unitary, injection-molded raised flooring panel 20.

While reference herein is made to a unitary panel 20, it is to be understood that the panel 20 can be integrally formed from separate sections and joined or bonded together using a suitable adhesive, such as polyvinyl chloride or acrylonitrile butadiene styrene or by ultrasonic sound. The advantage in integrating the panel 20 into an unitary structure in this manner is to reduce shrink marks on the upper surface of the panel 20. Shrink makrs have been known to occur in products which are formed by an injection molding and have various thicknesses.

It is within the contemplation of the present invention to construct the panel 20 so that the flooring wall 64 is made of one type of plastic material, such as acrylonitrile butadiene styrene, and the reinforcing ribs 62 are made of another type of plastic material, such as polyvinyl chloride. The plastic material above-described for the flooring wall 64 tends to last longer and has chemical resistant characteristics. The plastic material above-described for the base 62*a* and ribs 62 tends to be stronger.

An advantage to the use of the above-described plastic material for the injection molding of the panels 20 is that the resulting panel 20 may be configured to conform to various patterns or to conform to various shapes. Such panels can be cut or drilled without affecting the structural strength and integrity of the panels.

The panel support pedestal 26 (FIG. 7) comprises the panel support head 72 with a depending cylindrical collar 90. Seated on the subfloor 18 is a base 91 of the pedestal 26, which is formed with an upstanding collar 92. A tube 93 is received by the collars 90 and 92. At the center of the panel 20, the bottom surface of the reinforcing ribs 62 seat on and are fixed to the support head 72 by a suitable adhesive. A central raised section of the support head 72 is reduced in dimensions and enters the central opening between the reinforcing ribs 62. The panel support pedestal 26 is made, in the exemplary embodiment, from polyvinyl chloride. A suitable adhesive is applied to the exterior wall ends of the tube 93 and to the interior walls of the collars 90 and 92 before the panel 20 is fixed to the grid 12. As the panel 20 is urged downwardly into place, the tube 93 self adjusts within the collars 90 and 92 to seek out its proper height. When the adhesive sets, the support pedestal 26 becomes rigid.

We claim:

1. A raised flooring assembly comprising:

A. a plurality of grid support pedestals supported by a subfloor;

B. a grid including a plurality of flooring panel support stringers supported by and secured to said grid support pedestals;

C. a plurality of panel support pedestals supported by the subfloor; and

D. a plurality of unitary, injection-molded raised flooring panels supported on the flooring panel support stringers of said grid, each of said unitary, injection-molded raised flooring panel including (a) a continuous flooring wall having an upper flooring surface, (b) a plurality of mutually intersecting reinforcing ribs formed integrally with and depending downward from the surface of said flooring wall opposite to the upper flooring surface thereof, said reinforcing ribs being spaced from said subfloor, and (c) a plurality of mutual intersecting reinforcing central ribs at the central section of said flooring panels seating on said panel support pedestals respectively for support, said central ribs being formed integrally with and depending downward from the surface of said flooring wall opposite to the upper flooring surface thereof.

2. A raised flooring assembly as claimed in claim 1 wherein each said unitary, injection-molded raised flooring panel includes an aperture formed into its associated mutually intersecting reinforcing central ribs in the vicinity of the center of said associated unitary, injection-molded raised flooring panel, each of said panel support pedestals being formed with a raised, reduced dimension section received by said apertures respectively.

3. A panel support pedestal for a raised flooring assembly comprising:

(a) a base adapted to be supported on a subfloor;

(b) plastic telescoping tubes supported by said base and adapted for adjusting the height of said pedestal, said telescoping tubes being adhesively secured in an adjustd height for said pedestal; and (c) a head supported by said telescoping tubes to seat and support thereon a floor panel.

4. A panel support pedestal as claimed in claim 3 wherein said head comprises a raised, reduced dimension section and adapted for entering an opening in the floor panel supported by said head.

* * * * *